US009291435B2

(12) United States Patent
Scheid et al.

(10) Patent No.: US 9,291,435 B2
(45) Date of Patent: Mar. 22, 2016

(54) SHAPED CHARGE INCLUDING STRUCTURES AND COMPOSITIONS HAVING LOWER EXPLOSIVE CHARGE TO LINER MASS RATIO

(71) Applicant: The United States of America as represented by the Secretary of the Navy, Washington, DC (US)

(72) Inventors: Eric Scheid, Bloomington, IN (US); Kevin Hovden, Burlington, IA (US); Michael Murphy, Livermore, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/584,426

(22) Filed: Dec. 29, 2014

(65) Prior Publication Data

US 2015/0323294 A1 Nov. 12, 2015

Related U.S. Application Data

(60) Provisional application No. 61/922,759, filed on Dec. 31, 2013.

(51) Int. Cl.
*F42B 1/02* (2006.01)
*F42B 1/032* (2006.01)
*F42B 1/036* (2006.01)

(52) U.S. Cl.
CPC . *F42B 1/02* (2013.01); *F42B 1/032* (2013.01); *F42B 1/036* (2013.01)

(58) Field of Classification Search
USPC ..... 102/306, 307, 476
See application file for complete search history.

(56) References Cited

U.S. PATENT DOCUMENTS 2,809,585 A * 10/1957 Moses ..... F42B 1/024 102/476
2,900,905 A * 8/1959 MacDougal ..... F42B 1/024 102/306
3,034,393 A * 5/1962 Lieberman et al. ..... F42B 1/036 102/306
3,136,249 A * 6/1964 Poulter ..... F42B 1/032 102/309
3,561,361 A * 2/1971 Kessenich et al. ..... F42B 1/024 102/307
4,050,381 A * 9/1977 Heinemann ..... F42B 1/024 102/211
4,111,126 A * 9/1978 Thomanek ..... F42B 12/18 102/476
4,250,792 A * 2/1981 Deigmuller ..... F42B 33/025 102/309
4,425,850 A * 1/1984 Grössler ..... F42B 23/04 102/307

(Continued)

OTHER PUBLICATIONS

William Waters, Introduction to Shaped Charges, Army Research Laboratory Report, Mar. 2007, Aberdeen Proving Ground, MD.

*Primary Examiner* — Bret Hayes
(74) *Attorney, Agent, or Firm* — Christopher A. Monsey

(57) ABSTRACT

An improved shaped charge apparatus and method of manufacturing is provided including a composite wave shaper, a main charge, and a metal liner. An exemplary embodiment's wave shaper can be adapted to manipulate a shock front so that an interaction of the main charge and the metal liner occurs lower along the liner's profile such that the apparatus restricts an initial elongation of a resulting jet. An embodiment can have a thickness of the metal liner sufficient to provide a mass necessary to generate a first size diameter aperture in a target material. An embodiment an also provide a combination of the liner thickness and shock interaction point resulting in the jet having an improved length to diameter ratio among other advantages. An embodiment of the invention can also provide other advantages such as an explosive to mass ratio of less than 3 or 2 to 1.

6 Claims, 7 Drawing Sheets

(56) References Cited

U.S. PATENT DOCUMENTS 4,436,033 A * 3/1984 Precoul ..... F42B 1/028 102/307
4,455,914 A * 6/1984 Christmann ..... F42B 33/025 102/476
4,594,947 A * 6/1986 Aubry ..... F42B 1/024 102/307
4,672,896 A * 6/1987 Precoul ..... F42B 1/028 102/309
5,322,020 A * 6/1994 Bernard ..... F42B 1/024 102/306
5,323,681 A * 6/1994 McDevitt, Jr. ..... F42B 1/036 264/3.1
5,565,644 A * 10/1996 Chawla ..... F42B 1/024 102/307
5,939,663 A * 8/1999 Walters ..... F42C 19/0842 102/306
6,167,811 B1 * 1/2001 Walters ..... F42B 1/02 102/307
6,393,991 B1 * 5/2002 Funston ..... F42B 1/028 102/306
6,467,416 B1 * 10/2002 Daniels ..... F42B 12/10 102/476
6,615,736 B2 * 9/2003 Duparc ..... F42C 19/0846 102/306
6,983,698 B1 * 1/2006 Walters ..... F42B 1/024 102/305
7,752,972 B1 * 7/2010 Baker ..... F42B 1/024 102/309
7,779,760 B2 * 8/2010 Konig ..... E21B 43/118 102/306

* cited by examiner

SHAPED CHARGE INCLUDING STRUCTURES AND COMPOSITIONS HAVING LOWER EXPLOSIVE CHARGE TO LINER MASS RATIO

CROSS-REFERENCE TO RELATED APPLICATIONS

The present application claims priority to U.S. Provisional Patent Application Ser. No. 61/922,759, filed Dec. 31, 2013, entitled "SHAPED CHARGE, LOW EXPLOSIVE TO LINER MASS RATIO," the disclosure of which is expressly incorporated by reference herein.

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon. The invention was also at least partially conceived or first reduced to practice under Contract No. N00164-09-D-JM37 DO0004. This invention (Navy Case 103,031) is assigned to the United States Government and is available for licensing for commercial purposes. Licensing and technical inquiries may be directed to the Technology Transfer Office, Naval Surface Warfare Center Crane, email: Cran_CTO@navy.mil

BACKGROUND AND SUMMARY

The present invention relates to an improved shaped charge with a low explosive to liner mass ratio.

Existing shaped charges designed for applications such as breaching rock or concrete have a variety of disadvantages. For example, existing charges can be too small or too large to generate a desired or needed effect. A number of small charges, e.g., oil well perforators, can penetrate over a foot into rock but only generate very small holes, e.g., less than ¼ inch in diameter. Other specialized charges can penetrate many feet of concrete but are associated with unacceptably large loads. Needs addressed by the invention include requirements for a minimized explosive weight that still produces a desired hole, e.g., large diameter hole with, e.g., an intermediate depth of penetration.

An apparatus in accordance with an embodiment of the invention can include a shaped charge which provides a scalable apparatus suitable for applications previously unattainable. For example, exemplary manufacturing process, apparatus, or structure in accordance with various embodiments of the invention allow for scaling that can alter selected performance characteristics, e.g., target hole diameter, target hole depth, charge size, charge explosive weight while reducing net explosive weight (NEW) as well as penetration depth produced by an exemplary charge capable of producing a desired diameter result. Embodiments of the invention also include other process steps more fully described herein as well.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

An exemplary embodiment can be produced by an approach entailing a design process which includes performing an energy balance analysis in order to achieve a design capable of producing novel results/effects. Energy delivered by a shaped charge is kinetic and delivered to a target by, for example, a shaped charge jet. The exemplary jet can be a solid/elongated rod of extruded material generated by the explosive collapse of a shaped liner charge. The explosive energy can be manipulated with a design of an initiation apparatus or process, a shape of an explosive, and a shape (e.g. profile) of a liner. Manipulation of the explosive energy can control collapse of the liner and therefore a resulting shape (e.g. length/diameter) and speed of the shaped charge jet. At one or more phases, work on the target is kinetic and therefore can be a factor of a mass of the liner interacting with the target and its velocity.

Figure 1:
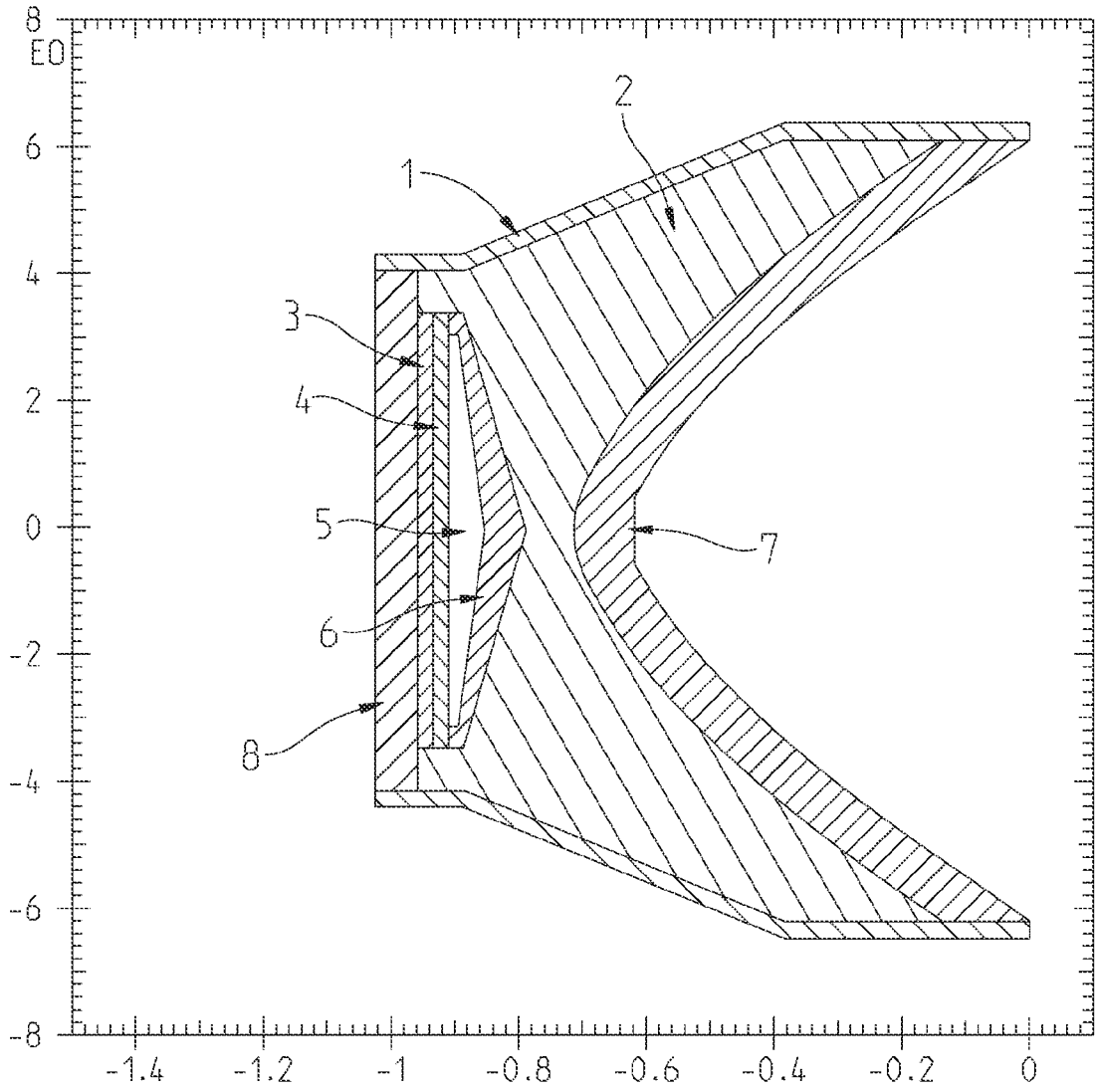
FIG. 1 show a cross section of an exemplary embodiment of the invention.

Referring initially to FIG. 1, an exemplary embodiment of the invention is shown. The FIG. 1 design includes a charge cover or case 1 that has a cylindrical outer wall with three sections (See FIGS. 2, 1A, 1B, and 1C) each having different diameters and a first and second circular opening (See FIGS. 2, 1D (not visible in FIG. 2 due to orientation) and 1E) where the first and second circular opening respectively have a first and second diameter, the first and second circular openings each define a first and second plane that are parallel to each other, said first and second openings have center sections which are coaxially aligned with each other along a first axis. The first section 1A of case or cover 1 has a smaller diameter than the second section 1B, and second section 1B has a smaller diameter than 1C of the charge cover or case 1. Embodiment elements are disposed within the case or cover 1 including a circular flat rear cover 8 which is disposed and fixed within the case or cover's 1 first opening 1D (not visible due to orientation) where the rear cover 8 has a first cover side (an outer side facing away from other elements on an opposing side of the rear cover 8 of this embodiment) that is substantially flush with an edge of the cover or case 1 sidewall defined by the first opening 1D. The rear cover 8 has a second cover side that is on an opposing side of the first cover side of the rear cover 8. This embodiment next has a flat circular shaped booster explosive 3 (e.g., datasheet C3 explosive) having a first explosive booster side and a second explosive booster side that is on an opposing side of the booster explosive 3, where the first booster explosive side is disposed in close proximity to the second cover side of the rear cover 8. The booster explosive 3 is formed having a first booster explosive diameter that is a smaller diameter than the rear cover 8. Booster explosive 3 is formed in a substantially flat circular shape. Next, a circular flat stainless steel disk 4 having a first disk side and an opposing second disk side is disposed next to the booster explosive 3 where the first disk side is oriented towards the second explosive booster side. The stainless steel disk is a tamper that holds back shock or wave produced by the explosive booster 3 from the main charge 2. Next, a circular composite wave shaper 6 (e.g., syntactic foam wave shaper) is disposed in proximity to the stainless steel disk 4 where the composite waver shaper 6 has a first and second wave shaper side and a wave shaper outer diameter that is equal or substantially equal to the first booster explosive diameter. The composite wave shaper 6 first wave shaper side is formed in a substantially conical or bowl shape that is inwardly oriented towards an apex defined by two sides of the conical or bowl shaped face of the first wave shaper side. The composite wave shaper 6 second wave shaper side is on an opposing side of the waver shaper's 6 first wave shaper side. The second wave shaper side is also formed in an inwardly facing conical or bowl shape where the second wave shaper side's apex is formed to orient away from the stainless steel disk 4. The second wave shaper side conic shape is formed with a different angle than the first wave shaper side's conic shape. The wave shaper 6 is further formed with an outer edge section which defines an outer diameter section of the wave shaper 6 and further has a protrusion section which extends away from an upper edge of the first wave shaper side's conic or bowl shape such that the outer diameter section surrounds the first wave shaper side's conic or bowl shape and extends away from it at a first predetermined distance and has a first predetermined width. The stainless steel disk 4 abuts and is in contact with an edge of the protrusion section of the outer edge section. An air gap 5 is defined by space between the stainless steel disk 4 and the first wave shaper side. Next, a main charge 2 (e.g., LX-14, PBXN-11, PBXN-9, etc.) is disposed on the case or cover 1 which has a cavity on a first main charge side that is shaped to receive the wave shaper 6, stainless steel disk 4, and the explosive booster 3 so that the main charge 2 surrounds the wave shaper 6, steel disk 4, and explosive booster 3 and an outer section of the main charge abuts the rear cover 8. The main charge 2 has a second main charge side that opposes the first main charge side and is further substantially conical or bowl shaped with a second main charge side apex which is oriented towards the rear cover 8. Next, a metal liner 7 (e.g., aluminum, e.g., 1100-O aluminum liner) is disposed within the case or cover 1 which has a conical or bowl shape which substantially matches or is formed to fit and come in contact with the second main charge side's conical or bowl shape and is formed extending outwardly to come in contact with an interior section of the case or cover 1. The metal liner 7 has a first and second liner side both having a conical shape and respectively defining a first and second liner apex. The first liner side is oriented towards the main charge 2 and the second liner side is oriented away from the main charge 2. The exemplary charge cover or case 1 can be formed from, e.g., acrylic. The exemplary rear cover 8 can be formed from, e.g., acrylic. In this embodiment, the exemplary rear case 1, cover 8, booster explosive 3, stainless steel disk 4, air gap 5, wave shaper 6, main charge 2, and metal liner 7 are formed with center sections that are coaxially aligned with each other within the case 1.

In one embodiment, explosive booster 3 can be separated from main charge 2 except along an outside rim of booster 3. This configuration of the contact between explosive booster 3 and main charge 2 at a the explosive booster's periphery coupled with air gap 5, stainless steel disk 4, and conic wave shaper 6 configures explosive booster 3 for producing a faster shock or wave front laterally through the explosive booster 3 and a retarded or slower wave front directed towards impacting or shocking a center section of main charge 2. This exemplary configuration shown in FIG. 1 prevents an earlier or first wave impact or shock to the first liner side at the first liner apex of the metal liner 7 and thus creates an undesired conversion of the metal liner 7 into an elongated jet by a center initiation of the main charge 2. Wave shaper 6 manipulates the shock front generated from explosive booster 3 so that the shock front from explosive booster 3 detonates the main charge 2 simultaneously along an outside rim of explosive booster 3, where explosive booster 3 is in contact with main charge 2. In this embodiment, the shock front from the explosive booster 3 travels faster through the explosive booster 3 than through the stainless disk 4 and the air gap 5 thus lateral shock waves through the explosive booster 3 impact the main charge 2 faster than a shock wave oriented non-laterally away from the explosive booster 3 towards a more central section of the main charge 2. The exemplary embodiment in FIG. 1 allows for wave shaper 6 to be thinner than existing designs because passage of the shock wave through wave shaper 6 from detonation of explosive booster 3 is controlled by closure of the air gap 5 from movement of stainless steel disk 4. Moreover, manipulation by wave shaper 6 of the shock wave or front from booster 3 results in an interaction of main charge 2 and metal liner 7 that occurs lower along a profile of the metal liner 7 and thus results in metal liner 7 moving as a more compact jet rather than a highly elongated jet. This exemplary design restricts elongation of a resulting jet because jet elongation is a function of a difference in a velocity of a material at the apex of metal liner 7 and material lower along the profile of metal liner 7. This restricted jet elongation results in a slower tip, lower strain rates, and compact jet that makes a larger diameter hole in a material or target of interest.

In this embodiment, a thickness of metal liner 7 provides a mass necessary to generate large diameter holes. A combination of a thickness of metal liner 7 and shock interaction point between main charge 2 and metal liner 7 away from the apex (e.g., first and second) of metal liner 7 results in a jet with a length to diameter (L/D) ratio that is atypical for shaped charges. Typical high explosive or explosive (charge) to liner (C/LM) mass ratios for existing shaped charges are well over 5 to 1, e.g., 9.5. The FIG. 1 exemplary charge 2 design, e.g., charge mass of 755 g with a liner mass of 365.6 g, can produce a C/LM ratio of less than 2.1 to 1. In accordance with various embodiments, a resulting jet can be shorter and wider with significant reduction in net explosive weight (NEW) (e.g., over 30%), than existing designs. Thus, some embodiments can be designed that have substantially less NEW and creates a jet that results in significant less penetration depth but a wider resulting hole diameter is possible. A result of the FIG. 1 exemplary embodiment can include a jet that produces large and consistent diameter holes with a reduced explosive weight (e.g., NEW). In some embodiments, energy delivered can still be sufficient to penetrate approximately two feet of many types of target material. A use of soft aluminum for constructing metal liner 7 ensures that a resulting hole is not plugged with a shaped charge jet slug. Use of a precision, forged liner, ensures an optimal collapse and consistent performance. Diameter or shape of a resulting hole created by an embodiment of this invention can be adjusted by varying stand-off distance from a particular area or target surface or structure of interest.

Advantages of exemplary embodiments of the invention include an ability to produce large diameter, cylindrical holes with, e.g., sixty percent less explosive than existing designs would require. Another advantage is a reduction of explosive weight which increases utility of exemplary embodiments given collateral damage is reduced. Other advantages include increased safety due to decrease of explosive weight. Embodiments of the invention can be used in demolition, mining, and well drilling operations as well as providing applications in rescue and ability to quickly drill holes for, e.g., rock bolts for emergency shoring.

Figure 2:
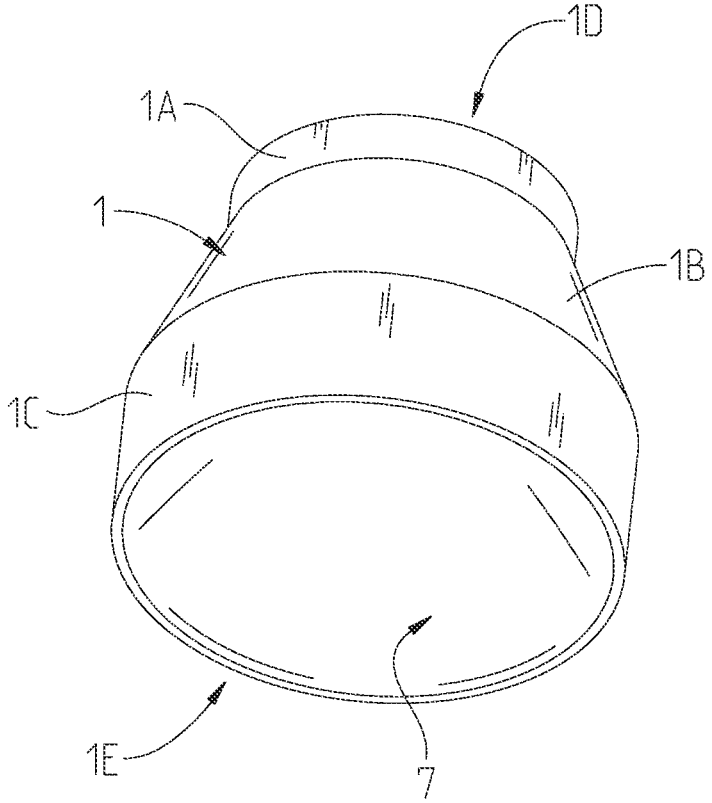
FIG. 2 shows a perspective external view of an exemplary embodiment of the invention.
Figure 3:
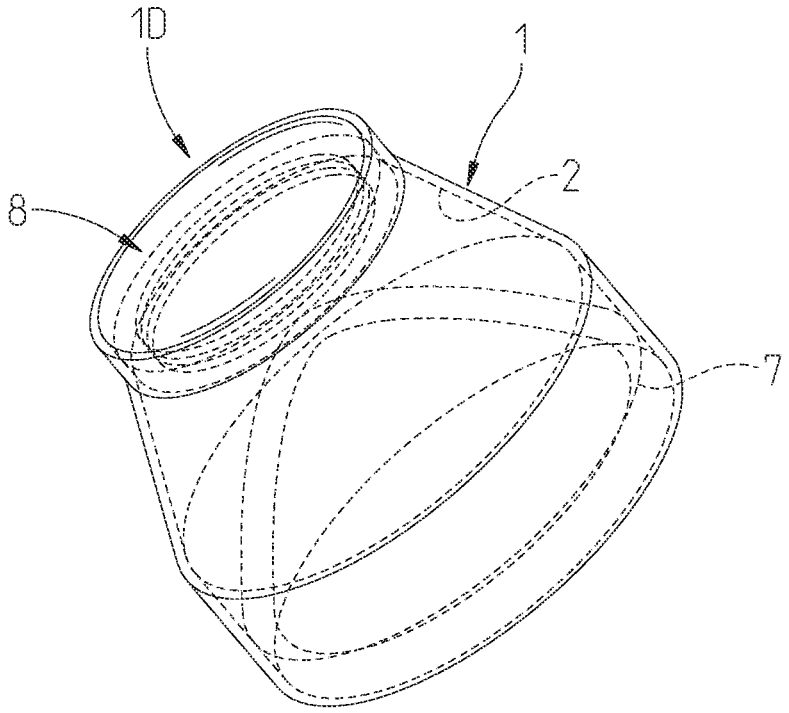
FIG. 3 shows a perspective external view of an exemplary embodiment of the invention with an external cover 1 removed.
Figure 4:
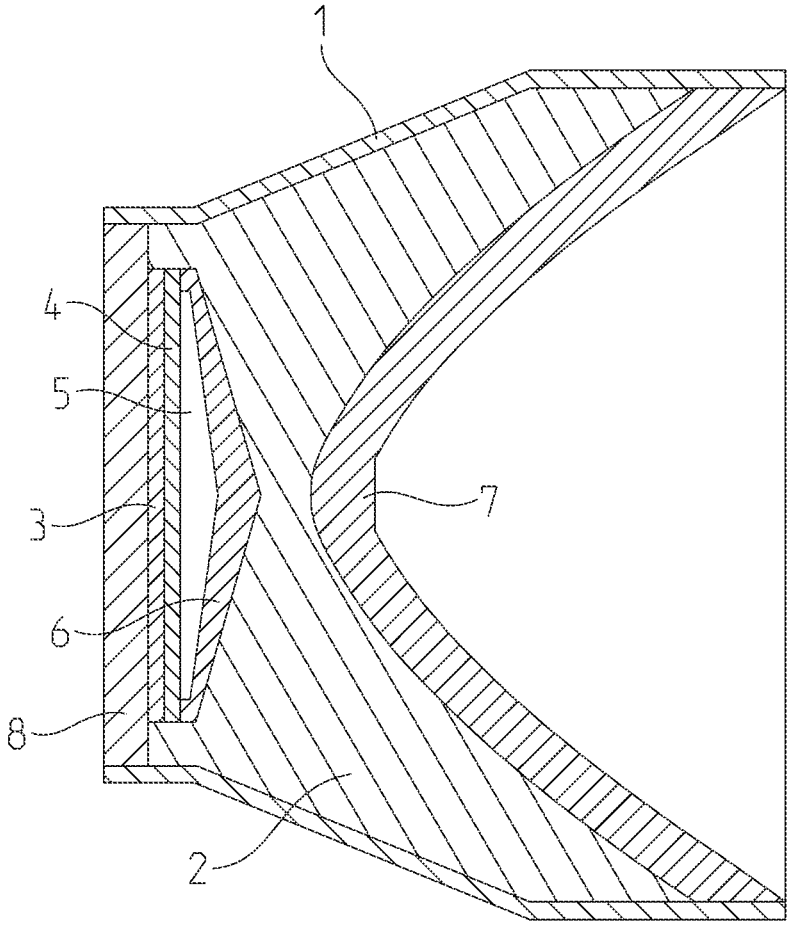
FIG. 4 shows an exemplary embodiment's cross section view similar to what is shown in FIGS. 1-3 with exemplary dimensions for various elements of the displayed embodiment.

Referring to FIGS. 2 and 3, each shows different perspective external views of an exemplary embodiment of the invention such as is also shown, for example, in FIGS. 1 and 4. FIG. 3 shows plastic cover 1 and a concave or conical metal liner 7 (e.g., an aluminum liner). FIG. 3 shows plastic cover 1 and rear cover 8. As discussed with reference to FIG. 1 above, the FIGS. 2 and 3 embodiments also show charge cover or case 1 that has the cylindrical outer wall with three sections (1A, 1B, and 1C) each having different diameters and the first and second circular opening (See FIGS. 2, 1D (not visible in FIG. 2 due to orientation) and 1E) where the first and second circular opening respectively have first and second diameters, the first and second circular openings each define first and second planes that are parallel to each other; the first and second openings have center sections coaxially aligned with each other as discussed above with respect to the first axis. The first section 1A of case or cover 1 has a smaller diameter than the second section 1B, and second section 1B has a smaller diameter than 1C of the charge cover or case 1.

Referring to FIG. 4, another cross section of an exemplary embodiment such as described with respect to FIG. 1-3 is shown with exemplary dimensions. The FIG. 4 embodiment includes embodiment elements as discussed with regard to FIG. 1 to include case 1, rear cover 8, explosive booster 3, stainless steel disk 4, air gap 5, wave shaper 6, main charge 2, and metal liner 7 in a same or similar configuration as discussed with regard to FIG. 1. Other dimensions of this exemplary embodiment can include a charge 2 length of 102.4 mm, a charge 2 diameter of 127.0 mm, a total mass of 1312.2 g, high explosive mass of 754.8 g, liner mass of 365.6 g, jet mass (g) (v>1.5 mm/micro sec) of 110.0, jet energy (g–cm$^2$/micro sec$^2$) of 7.8.

Figure 5:
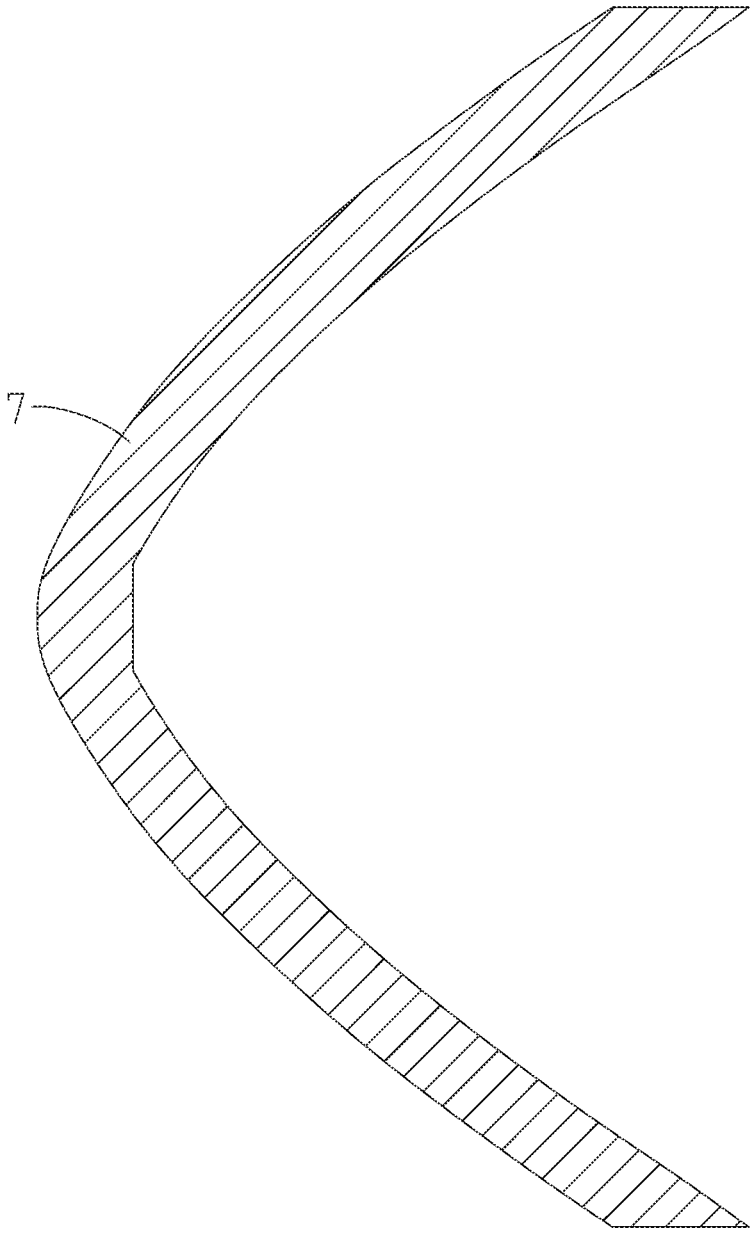
FIG. 5 shows a cross section view of an exemplary liner such as shown in FIGS. 1-4.

FIG. 5 shows a cross section view of an exemplary liner 7 such as shown in FIGS. 1-4. Various exemplary dimensions are also provided.

Figure 6:
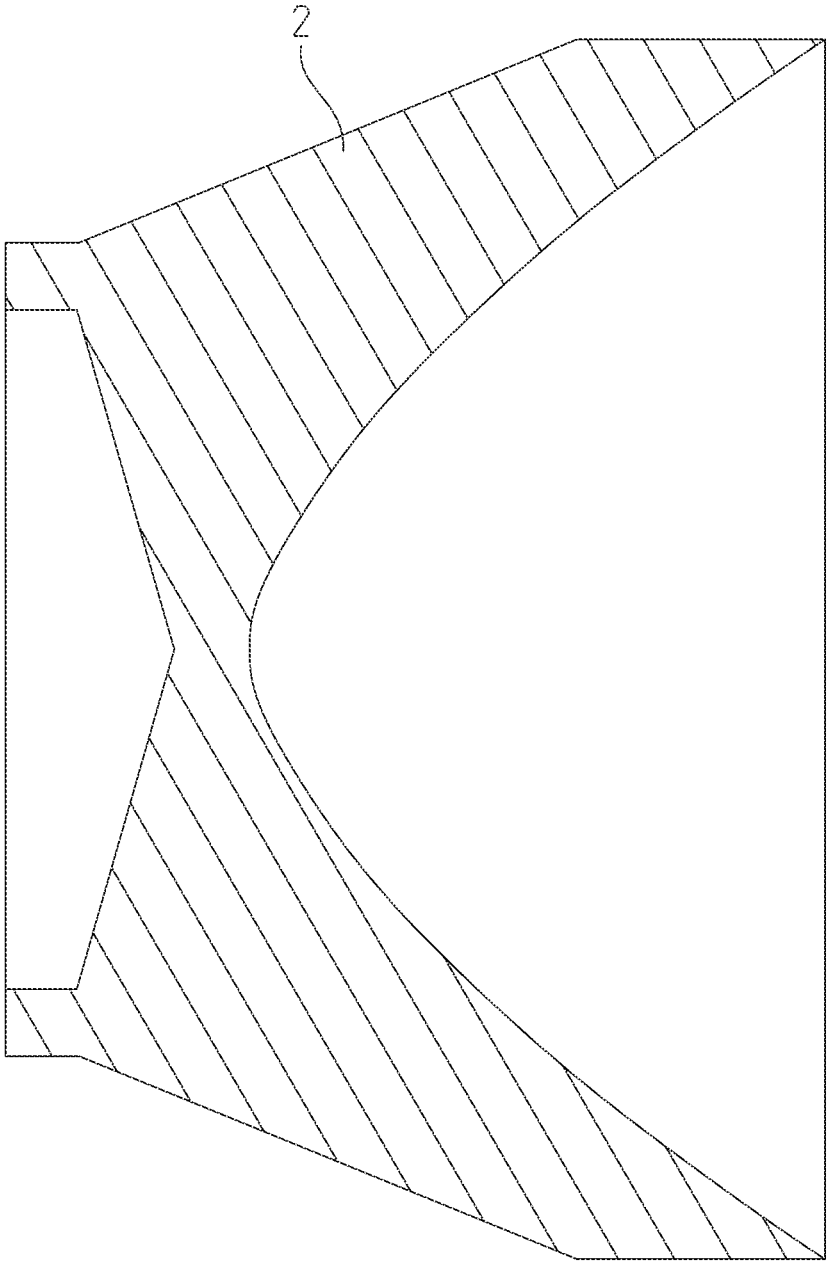
FIG. 6 shows a cross section view of an exemplary charge such as shown in FIGS. 1 and 4.

FIG. 6 shows a cross section view of an exemplary charge such as shown in FIGS. 1 and 4. Various exemplary dimensions are provided.

Figure 7:
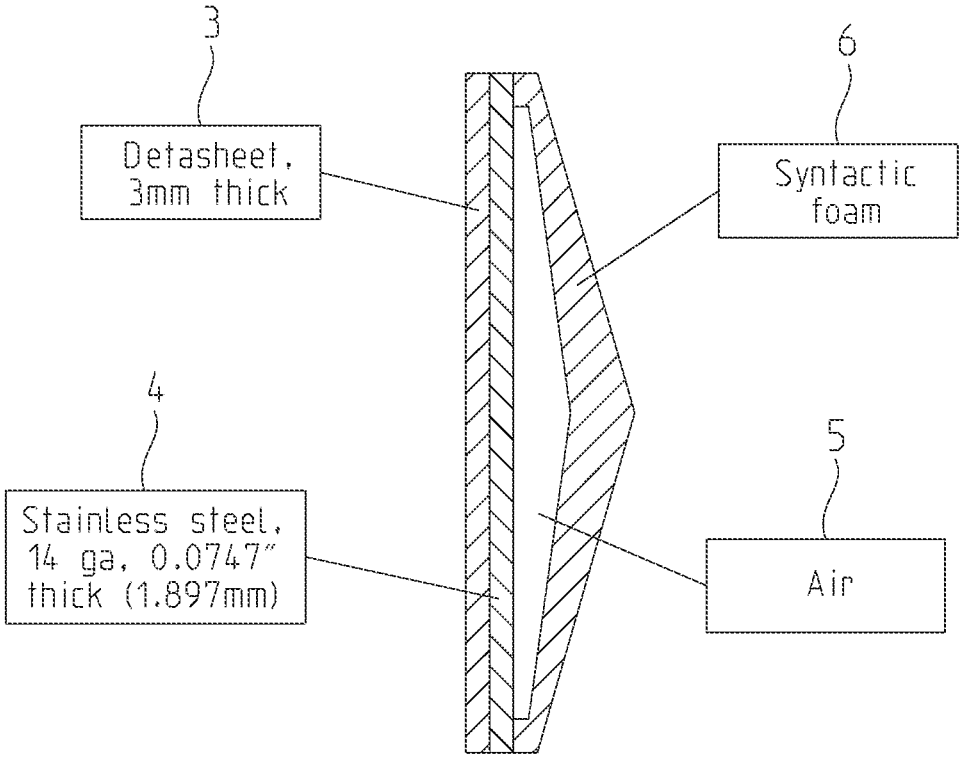
FIG. 7 shows a cross section view of an exemplary initiation and wave shaper section shown in FIGS. 1 and 4.

FIG. 7 shows a cross section view of an exemplary initiation and wave shaper section shown in FIGS. 1 and 4. Various exemplary dimensions are provided.

Figure 8:
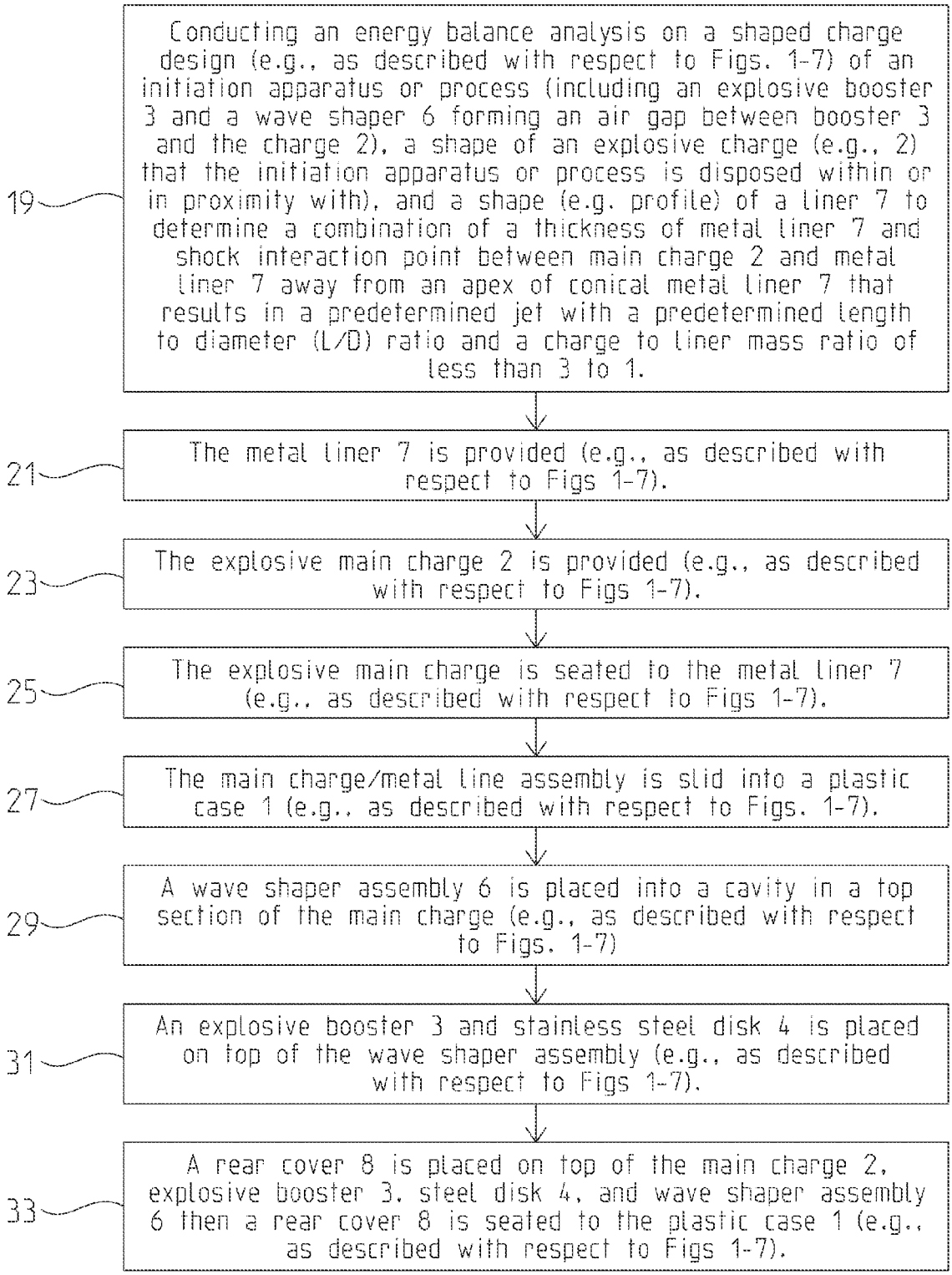
FIG. 8 shows a flowchart of an exemplary method of manufacturing an exemplary embodiment of the invention.

Referring to FIG. 8, an exemplary method is provided for manufacturing an embodiment of the invention. At step 19, an energy balance analysis is conducted on shaped charge design (e.g., as described with respect to FIGS. 1-7) of an initiation apparatus or process (including an explosive booster 3 and a wave shaper 6 forming an air gap between booster 3 and the charge 2), a shape of an explosive charge (e.g., 2) that the initiation apparatus or process is disposed within or in proximity with), and a shape (e.g. profile) of a liner 7 to determine a combination of a thickness of metal liner 7 and shock interaction point between main charge 2 and metal liner 7 away from an apex of conical metal liner 7 that results in a predetermined jet with a predetermined length to diameter (L/D) ratio and a charge to liner mass ratio of less than 3 to 1. At step 21, the metal liner 7 is provided in accordance with an embodiment of the invention such as, for example, discussed above with regard to FIGS. 1-7. Such a metal liner 7 can be forged to near its final shape. Machining can then be used to form the forged metal liner 7 to its final shape. This metal liner 7 can comprise aluminum and can comprise a very fine grain size. At step 23, the explosive main charge 2 is provided. (e.g., as described with respect to FIGS. 1-7). This exemplary main charge 2 can be pressed to near its final shape. Machining can then be used to form the pressed main charge 2 to its final shape. At step 25, an assembly is provided by seating the explosive main charge 2 in its final shape to the metal liner in its final shape. (e.g., as described with respect to FIGS. 1-7). This seating can be achieved, for example, with an adhesive. At step 27, an assembly comprising an explosive main charge in its final shape seated to a metal liner in its final shape is slid into a plastic case in its final shape. (e.g., as described with respect to FIGS. 1-7). This plastic case 1 can be, for example, machined or molded into its final shape. At step 29, a wave shaper assembly 6 is placed into a cavity in a top section of the main charge 2, i.e., the end of the main charge away from the metal liner. (e.g., as described with respect to FIGS. 1-7). At step 31, an explosive booster 3 and stainless steel disk 4 is placed on top of the wave shaper assembly. (e.g., as described with respect to FIGS. 1-7). At step 33, a rear cover 8 is placed on top of the main charge 2, explosive booster 3, steel disk 4, and waver shaper assembly 6 then a rear cover 8 is seated to the plastic case 1. (e.g., as described with respect to FIGS. 1-7). This seating of the edges of the rear cover to the plastic case can be achieved, for example, with adhesives.

Although the invention has been described in detail with reference to certain preferred embodiments, variations and modifications exist within the spirit and scope of the invention as described and defined in the following claims.

The invention claimed is:

1. A shaped charge apparatus comprising:

a wave shaper assembly;

a booster explosive;

a main charge; and a metal liner;

wherein said wave shaper assembly is adapted to manipulate a shock front from said booster explosive such that an initial interaction of said main charge and said metal liner occurs along a portion of said metal liner distal to said wave shaper assembly and thereby restricts an initial elongation of a resulting jet;

wherein a thickness of said metal liner provides a mass necessary to generate a first size diameter aperture in a target material;

wherein said wave shaper assembly comprises a composite wave shaper, a stainless steel plate adjacent to said booster explosive, and an air gap formed between said composite wave shaper and said stainless steel plate.

2. An apparatus as in claim 1, wherein said metal liner comprises an aluminum liner.

3. An apparatus as in claim 1, wherein said apparatus has an explosive to mass ratio of less than 2.1 to 1.

4. A method of manufacturing a shaped charge apparatus comprising:

forming a metal liner;

forming a main charge;

forming an assembly comprising said main charge seated to said metal liner;

sliding said assembly into a plastic case;

placing a wave shaper assembly into the top of said main charge;

placing a booster on top of said wave shaper assembly;

placing a rear cover on top of said main charge, said booster, and said wave shaper assembly; and seating said rear cover to said plastic case;

wherein said wave shaper assembly comprises a composite wave shaper, a stainless steel disk, and an air gap formed between said composite wave shaper and said stainless steel disk.

5. A method as in claim 4, wherein forming said metal liner comprises forging and machining said metal liner.

6. A method as in claim 4, wherein said metal liner comprises an aluminum liner.

* * * * *